United States Patent [19]

Hametner et al.

[11] 4,220,275

[45] Sep. 2, 1980

[54] FASTENER SELECTION SYSTEM

[75] Inventors: Albert L. Hametner, Seattle; Hollis B. Merrell, Renton; Brian R. Trethewy, Snohomish, all of Wash.

[73] Assignee: The Boeing Company, Seattle, Wash.

[21] Appl. No.: 929,073

[22] Filed: Jul. 31, 1978

[51] Int. Cl.[3] ..... B21J 15/28

[52] U.S. Cl. ..... 227/5; 227/69; 227/76; 340/347 M

[58] Field of Search ..... 227/5, 69, 76; 340/347 M

[56] References Cited

U.S. PATENT DOCUMENTS

| | | | |
|---|---|---|---|
| 3,030,832 | 4/1962 | Filangeri et al. | 227/5 |
| 3,041,469 | 6/1962 | Ross | 340/347 M |
| 3,573,801 | 4/1971 | Cohen et al. | 340/347 M |
| 3,594,766 | 7/1971 | Gilbert | 340/347 M |
| 3,843,103 | 10/1974 | Sekine et al. | 266/58 |
| 3,949,170 | 4/1976 | Shionoya | 340/347 M |

*Primary Examiner*—Paul A. Bell

*Attorney, Agent, or Firm*—Lynn H. Hess; B. A. Donahue

[57] ABSTRACT

An automatic fastener selection apparatus for sensing the composite thickness of a plurality of workpieces, determining which one of a plurality fastener sizes is appropriate for joining the workpieces together, and generating a dispensing signal representing the appropriate fastener size. Sensing apparatus provides a signal which is a function of the composite thickness of the workpieces, and this signal is processed by a selection circuit. The selection circuit generates an output signal in response to the signal from the sensing apparatus, and this output signal represents only one of a plurality of different fastener sizes. A triggering circuit then receives the output signal and generates the dispensing signal in response thereto. The apparatus may include a switching mechanism associated with the sensing apparatus and cooperating with the triggering circuit to generally synchronize the updating of the output signal and the generation of the dispensing signal with the completion of a thickness sensing operation. The apparatus may further include circuitry for facilitating the calibration of the selection circuit and a visual display for indicating the output signal, and the selection circuit may include enabling circuitry responsive both to the switching mechanism and to a manually-operable switch for enabling the triggering circuit.

38 Claims, 6 Drawing Figures

160
162
166c
176
176
+12V
166
164
166a
164a
80
+12V
78
82
144
146
144b
+12V
+12V
+12V
136
138
140
142
148
+12V
172a
172b
172
172c
170a
170
168
+12V
+12V
174
150
5VDC 12VDC 30VDC
POWER SUPPLY
62
110VAC
+12V
130
132
134
122
176
+12V
124
126
128
152a
152
154
156
152b
158
98

FASTENER SELECTION SYSTEM

BACKGROUND OF THE INVENTION

This invention relates to the automatic selection of appropriately-sized fasteners from a supply.

Fastener selection apparatus has commonly been used in the prior art in combination with fastener installation equipment such as riveting machinery. The purpose of the selection apparatus in such a context is to control the delivery of individual fasteners from a supply to the installation equipment, and this delivery is usually automatic in response to the activation, by an operator, of the selection apparatus.

In many commercial situations where automatic fastener-installation equipment such as riveting machines are used it is necessary to rivet workpieces of varying thickness. In such situations the rivet used for each individual riveting operation must be the proper length for that particular operation, and successive operations may require rivets of different lengths. Thus, a fastener selection apparatus which automatically senses the workpiece thickness for riveting operation and then automatically generates a dispensing signal representing the appropriate rivet length for that operation is required; and this fastener selection apparatus must also operate rapidly with high reliability and precision.

In the U.S. Pat. No. 3,030,832 to A. E. Filangeri et al, a riveting machine is disclosed which automatically senses the aggregate thickness of materials to be joined together and selects and transports a rivet of proper length from a supply for each riveting operation. A sensing of the aggregate thickness and a determination of the proper rivet length are accomplished by a mechanical linkage which is responsive to the sensed thickness for bridging a particular set of electrical contacts representing a corresponding rivet size. Bridging the electrical contacts causes a rivet to be dispensed from the supply.

Unfortunately, rivet selection apparatus such as the one disclosed in the Filangeri et al patent do not provide the degree of precision, versatility and reliability required in many modern applications.

SUMMARY OF THE INVENTION

It is therefore an object of the present invention to provide a fastener selection apparatus which provides precise and reliable selection of fasteners according to size based on a sensed composite thickness of the workpieces to which each particular fastener is to be applied, the selected fastener size in each instance being embodied in the output signal of a selection circuit where the output signal is determined in response to a signal which is proportional to the sensed composite thickness.

It is another object of the invention to provide a fastener selection apparatus wherein the generation of a dispensing signal representing a particular fastener size determined by a selection circuit as the result of a sensing operation is generally synchronized with the completion of the sensing operation.

It is another object of the invention to provide a fastener selection apparatus which allows the selective manual triggering of a dispensing signal which represents the same size of fastener represented by the next preceding dispensing signal.

It is yet another object of the present invention to provide a fastener selection apparatus which is easily calibrated for different numbers of selectable fastener sizes, and where each selectable fastener size may be provided in response to a corresponding range of sensed thicknesses which is infinitely adjustable between fixed limits.

In accordance with the present invention, a fastener selection apparatus includes sensing means for sensing the composite thickness of workpieces to be fastened together and for generating a signal having a signal level proportional to said composite thickness, a selection circuit responsive to the signal from the sensing means for providing an output signal determined by the selection circuit as a function of the signal level and representing a particular size of fastener, and means responsive to the output signal for generating a dispensing signal for that particular size of rivet.

In a fastener selection apparatus according to the invention, the selection circuit may include an analog to digital converter circuit responsive to an analog signal from the sensing means for generating a corresponding digital signal and a logic circuit for receiving the digital signal and generating an output signal representing a particular rivet size. The selection apparatus according to the invention may also include a triggering circuit which is responsive to both the output signal from the selection circuit and a switch associated with the sensing means for synchronizing the generation of a dispensing signal with the completion of the sensing operation.

The novel features which are characteristic of the present invention, and other objects and advantages thereof, will be better understood from the following detailed description and the accompanying drawings which together disclose the presently preferred embodiment of the invention.

DESCRIPTION OF THE PREFERRED EMBODIMENT

The present invention may be utilized in a variety of environments where automatic selection of fasteners according to size is desired. However, the invention is especially well suited for use with an automatic riveting machine where workpieces of varying thickness are being fastened together; and the invention will therefore be described in that environment.

The United States patent applications of Trethewy (Ser. No. 864,059, filed Dec. 23, 1977) and Caley et al (Ser. No. 869,966, filed Jan. 16, 1978) disclose a rivet dispensing apparatus and a rivet delivery and locating apparatus respectively. Since a description of the operation of the present invention will be facilitated by reference to the disclosures of these two earlier-filed applications, the Trethewy and Caley et al applications are fully incorporated herein by reference.

Figure 1:
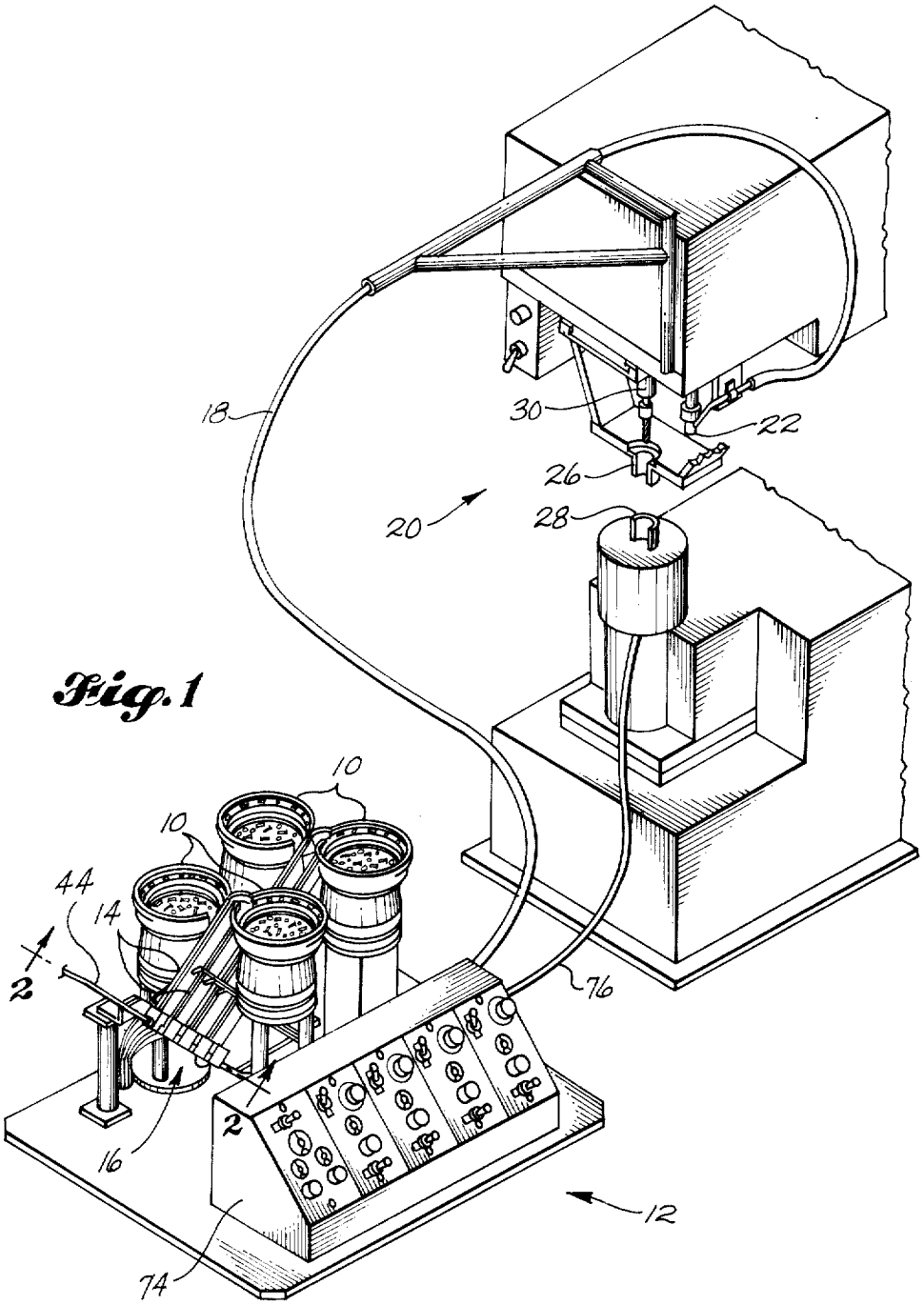
FIG. 1 is a pictorial view of an automatic riveting machine and an associated rivet storage and dispensing apparatus.

The apparatus shown in FIG. 1 comprises an automatic riveting system and may advantageously incorporate the present invention. The system performs a number of functions including storing of rivets segregated according to size, orienting the stored rivets and presenting them to a dispensing apparatus, sensing the composite workpiece thickness at the location where a riveting operation is to occur, triggering a dispensing signal to the dispensing apparatus to cause the dispensing of a single rivet of the selected size, conveying the individual rivet to the riveting machine, drilling a hole in the workpieces, locating the rivet with respect to the hole, and performing a heading operation on the located rivet.

As shown in FIG. 1, rivets are stored in containers 10 of a rivet storage and dispensing module 12, and several modules 12 may be connected together for use with a single riveting machine. Rivets are fed in an orientated manner from containers 10 along tracks 14 to a dispensing mechanism 16. When an individual rivet is dispensed by mechanism 16, it is fed through a conduit 18 to the riveting machine 20 and placed between rivet-gripping fingers 22 for subsequent locaion with respect to a hole in the workpieces 24*a*, 24*b*, and 24*c* (see FIG. 3).

Figure 3:
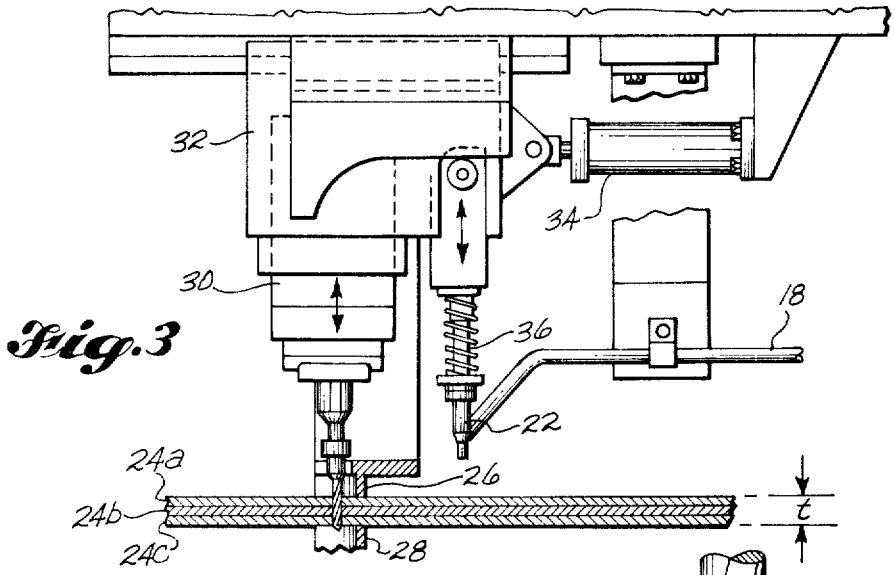
FIG. 3 is a side view of a part of the riveting machine during a drilling operation.

The workpieces are first inserted between upper and lower clamping members 26 and 28 respectively, and the lower clamping member 28 moves upwardly to clamp the workpieces in place between the members. The riveting machine then performs a drilling operation on the workpieces as shown in FIG. 3 while an individual rivet is being delivered from module 12 to the fingers 22. Upon completion of the drilling operation the drilling mechanism 30 moves upwardly, and a carriage 32 of machine 20 is moved forward by a pneumatic piston-cylinder device 34 so that the rivet-carrying fingers 22 are positioned over the hole. An anvil 36 moves downwardly to hold the rivet in its hole, and a ram 38 (see FIG. 4) comes up from below the workpieces to complete a heading operation on the rivet.

Figure 2:
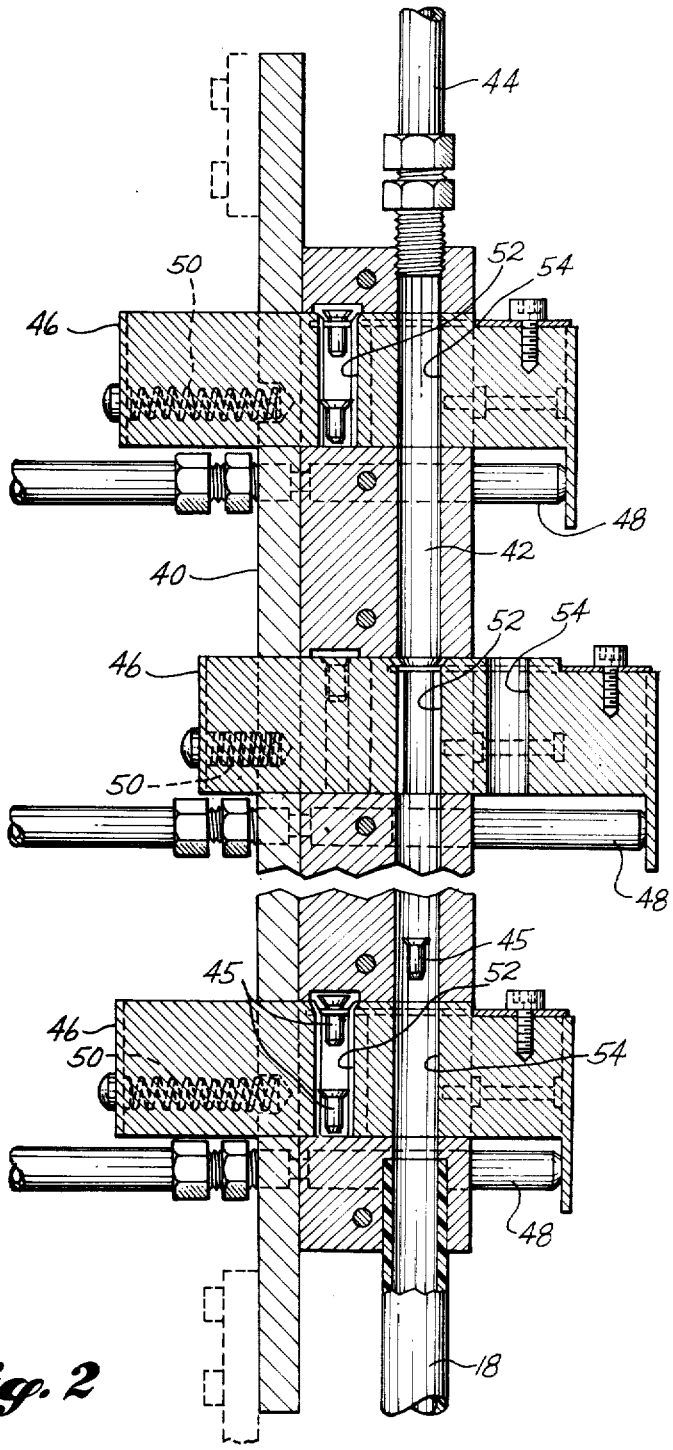
FIG. 2 is a section view of the dispensing apparatus taken generally along line 2—2 in FIG. 1.

The dispensing mechanism is shown in detail in FIG. 2. The dispensing mechanism 16 includes a body portion 40 which defines a through-passageway 42 communicating with the conduit 18. Compressed air from a compressed air source (not shown) enters passageway 42 through a line 44 and forces a rivet 45 in passageway 42 along conduit 18 to the fingers 22. The dispensing mechanism 16 also includes a plurality of gate members 46 which are individually movable by associated pneumatic piston-cylinder device 48 from a normal position to an actuated position and automatically returned by associated springs 50 to the normal position.

Each gate member 46 defines a first passageway 52 and a second passageway 54 therethrough such that with the gate member in its normal position passageway 52 is aligned with an associated track 14 and passageway 54 is aligned with through-passageway 42. However, while a gate member is in its actuated position its passageway 52 will be aligned with through-passageway 42. Indexing means (not shown) are provided on each gate member 46 for insuring that each time a gate member returns to its normal position a single rivet 45 will be delivered from its associated track to the passageway 52.

Therefore, while gate members 46 are in their normal positions each one will have only a single rivet within its passageway 52, and when a gate member moves to its actuated position it will deposit that rivet into through-passageway 42 for delivery to the riveting machine. Since the first gate member receives only rivets having a first length, the second gate member receives only rivets of a second length, and so on, the length of the rivet dispensed to the riveting machine for any given riveting operation will be determined by which gate member is actuated for that particular operation. The gate members are individually actuated by compressed air from an electromagnetic relay 56 (see FIG. 4) which is controlled by dispensing signals from a triggering circuit.

Figure 4:
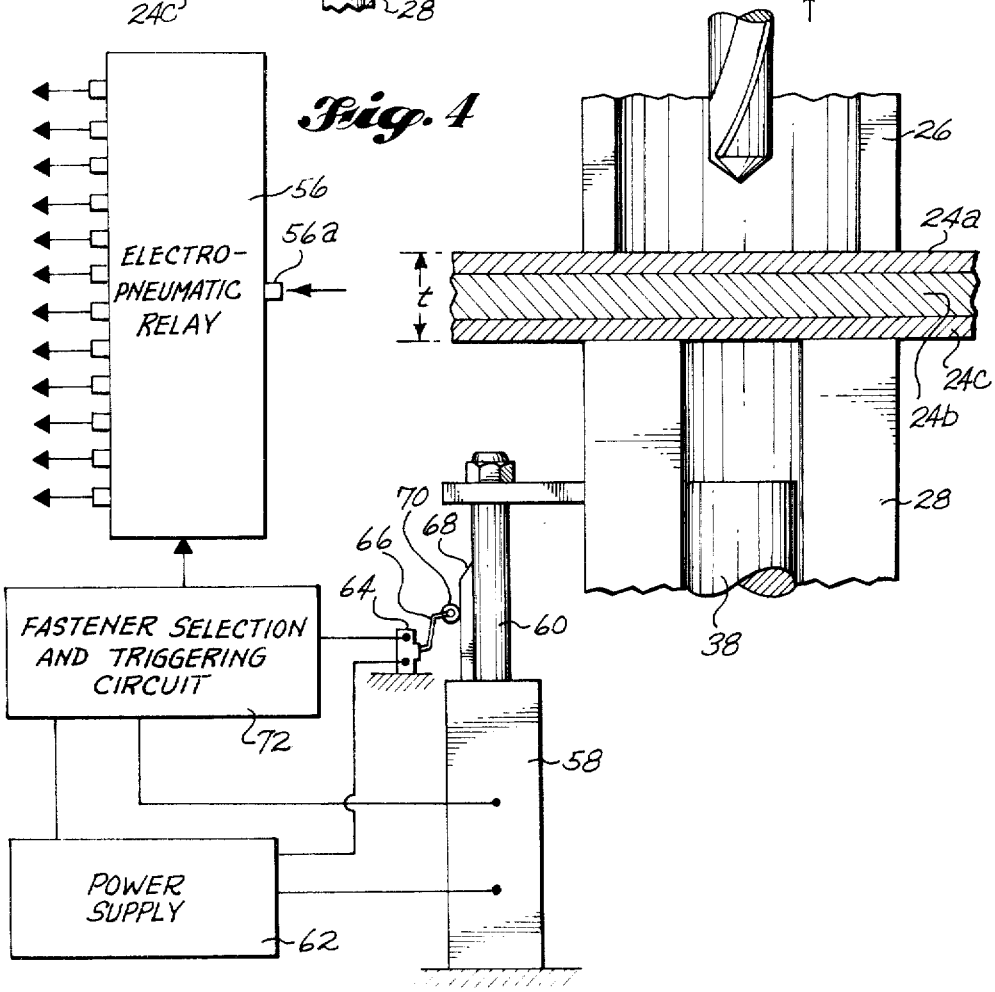
FIG. 4 is a schematic representation of the fastener selection apparatus according to the invention.

Referring now to FIG. 4, it wil be seen that sensing means in the form of a linear displacement device 58 includes a movable portion 60 which is fastened to, and moves with, the lower clamping member 28 so that the linear displacement device senses the position of lower clamping member 28 at all times. The linear displacement device is preferably a linear displacement variable transducer which generates an output signal which is an analog voltage signal proportional to the displacement of arm 60. The analog signal may be either directly or inversely proportional to the displacement depending on the particular circuitry being used. The linear displacement device may be powered by an electrical power supply 62.

The sensing means may also include a limit switch 64 having an actuator arm 66. A cam surface 68 is provided on movable portion 60 of the linear displacement device, and a cam follower 70 carried by the end of arm 66 cooperates with cam surface 68 to operate switch 64 in response to the position of lower clamping member 28.

A fastener selection and triggering circuit 72 receives power from power supply 62 and is responsive to both the analog voltage signal from the transducer 58 and a signal from switch 64 for providing dispensing signals to relay 56. As best seen in FIG. 1, the fastener selection and triggering circuitry 72 and the power supply 62 can both be conveniently located in a control console 74 mounted on the dispensing module 12, and connections between the console and the riveting machine can be made through conductors contained in a conduit 76.

Figure 5A:
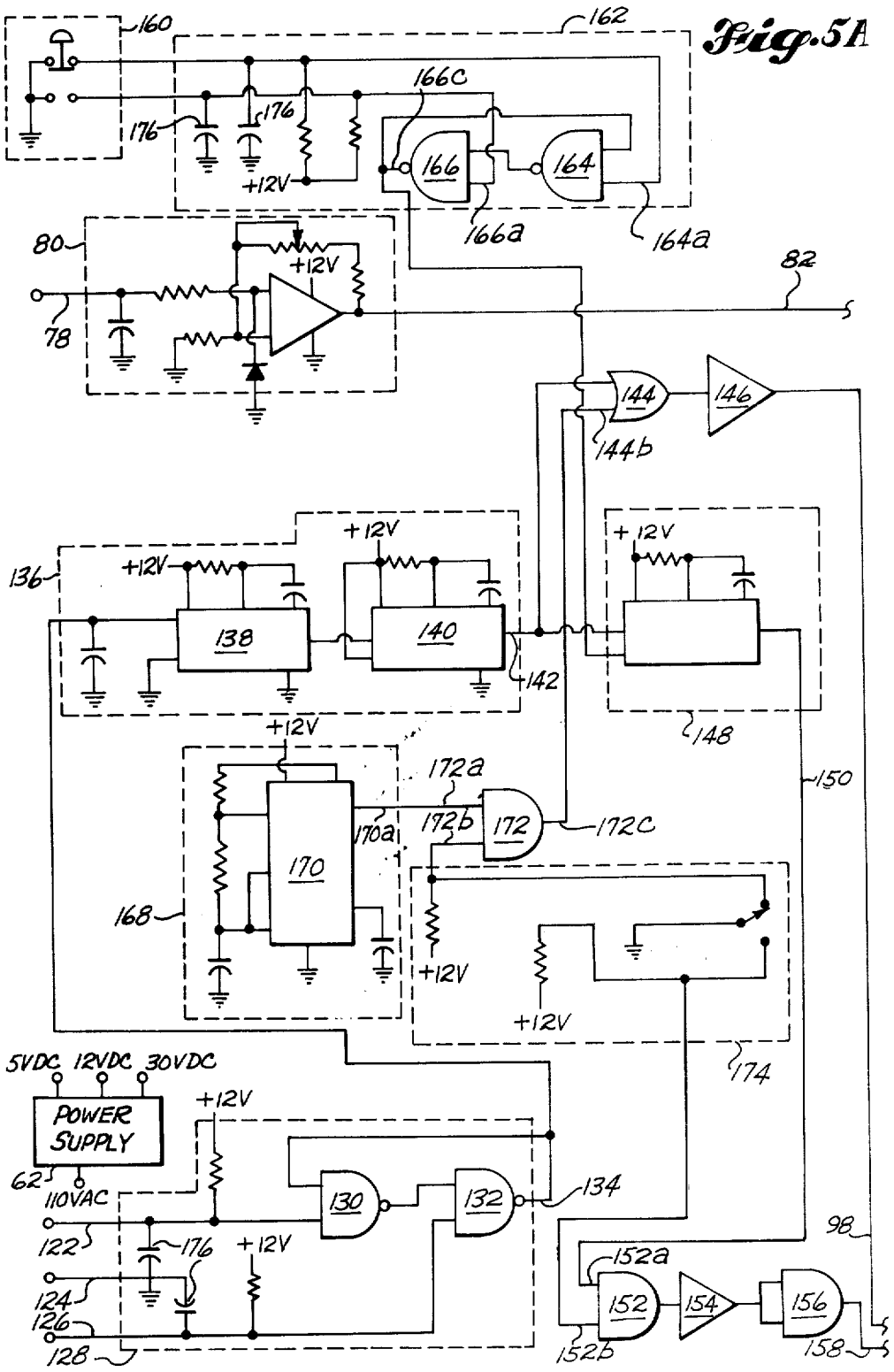
FIGS. 5A and 5B represent a circuit schematic of the selection apparatus according to the invention.
Figure 5B:
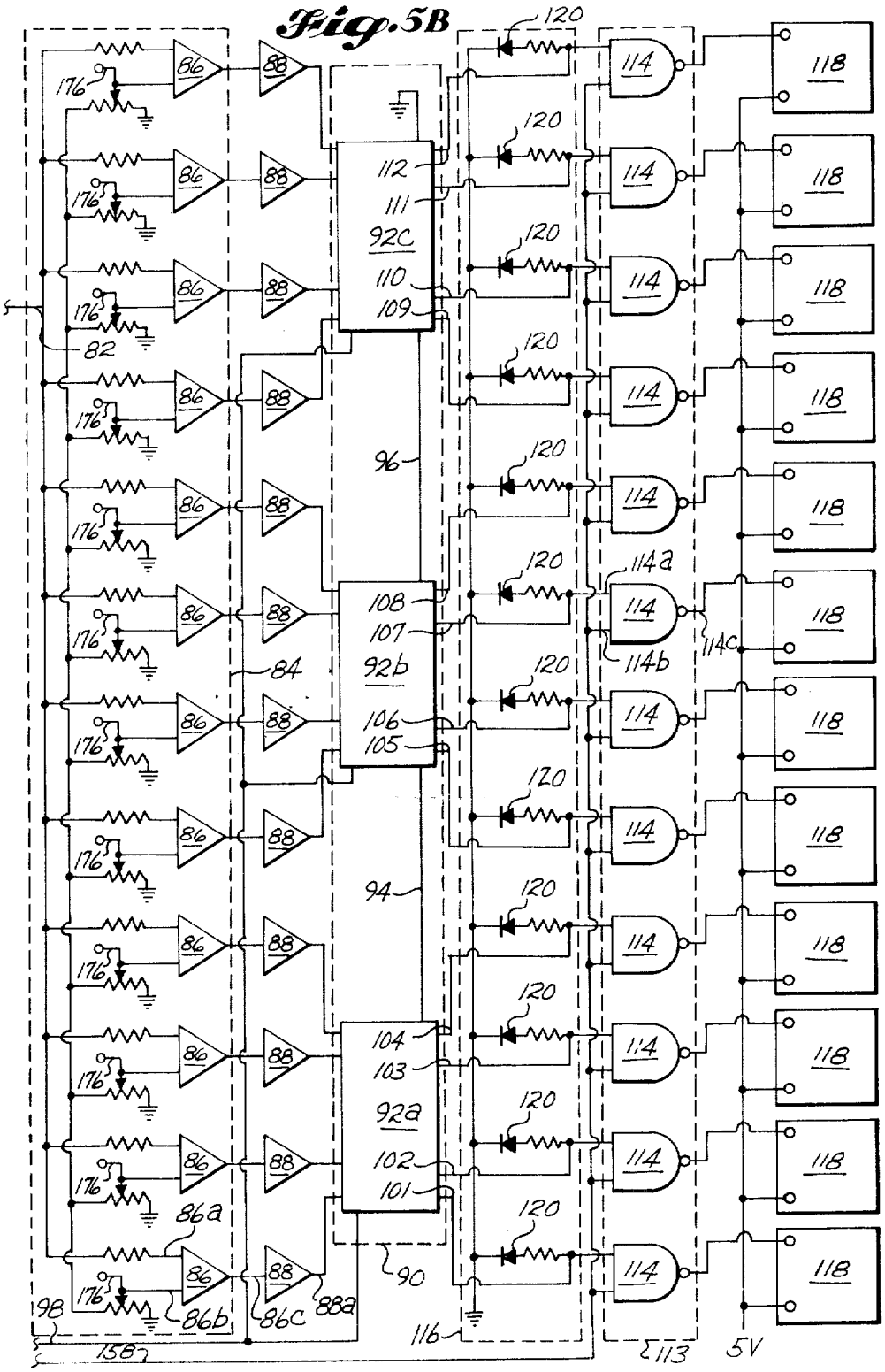

A circuit schematic for fastener selection and triggering circuit 72 is shown in FIGS. 5A and 5B. As seen in FIG. 5A, the analog voltage signal from linear displacement device 58 is provided to the fastener selection circuit at an input 78. The signal is received by a gain adjustment circuit 80 which may take the form of a band width amplifier; and, after being scaled by the circuit 80, the signal is provided to the input 82 of an analog-to-digital converter circuit 84. The gain adjustment circuit may be utilized to invert the analog signal from the linear displacement device, and although the gain adjustment circuit is not an essential component of the selection circuit it makes the selection circuit adaptable to a variety of different linear displacement devices.

The analog-to-digital converter circuit 84 as shown comprises twelve different voltage level sensing operational amplifiers 86. The analog signal from gain adjustment circuit 80 is applied to the non-inverting input 86*a* of each operational amplifier 86, and an adjustable reference voltage is applied to each of the inverting inputs 86*b*. The reference voltages applied to the inputs 86*b* are individually adjustable, and only those amplifiers seeing a reference voltage less than or equal to the analog signal will generate an output signal. Therefore, the analog signal provided at input 82 is converted to a digital signal comprising all twelve converter outputs 86*c*.

A level converting amplifier 88 may be connected to each individual output of the converter circuit 84. The function of these level converting amplifiers is to convert the 12 VDC CMOS signals from the converter circuit to 5 VDC TTL compatible signals. The TTL compatible signals at outputs 88*a* of the amplifiers 88 are then provided to a logic circuit 90 in the form of a TTL compatible digital signal.

The logic circuit 90 may comprise a priority latch circuit in the form of a laddered arrangement of latches. For example, twelve rivet selection latches may be provided by three SN74278 priority encoders 92*a*, 92*b*, and 92*c*. In such an arrangement each individual latch is responsive to a different one of the amplifier 88 outputs, and a latch may be set only in the presence of a signal from output 88*a* of its associated amplifier 88. Only one of the twelve priority latches may be set at any given time, and the latch which sets is the one closest to the top of the priority ladder. Once a latch is set it will remain set until the entire priority latch circuit is reset. As shown, each of the priority encoders 92 includes four individual priority latches, and each latch has both an input from an associated amplifier 88 and a corresponding output.

The priority latch outputs are identified in FIG. 5B by the numbers 101 to 112, and the one having the highest priority its output 112. The priority encoders are connected together by conductors 94 and 96 and function in such a way that all latches below the highest priority latch receiving an input signal from an output 88*a* will be disabled. An output signal will be generated only from the output for the latch which was set, and this output signal will be a continuous signal maintained until the logic circuit 90 is reset. Such a reset occurs only in response to a reset signal provided to each of the individual encoders 92 from a conductor 98.

The output signal generated at one of the outputs 101–112 is received by a corresponding one of a plurality of NAND gates 114 and by a display circuit 116. Each NAND gate 114 has a corresponding solid state relay or triac 118 electrically connected thereto, and the display circuit includes a plurality of light emitting diodes (LED's) 120 with one such LED associated with each output of the priority latch circuit. The LED 120 associated with the active latch circuit output will be turned on to indicate the presence of an output signal at its associated output. The triac 118 associated with the active latch circuit output is responsive to a dispensing signal from its associated NAND gate 114 for effecting a dispensing operation by the dispensing mechanism 16. A dispensing signal is defined, relative to the disclosed circuit, as an OVDC signal at the output 114*c* of the NAND gate associated with the active latch circuit output.

Referring now once again to FIG. 4 and also to FIG. 5A, leads 122, 124, and 126 of the selection circuit are connected to limit switch 64. Lead 124 is common, lead 122 provides a 12 VDC signal from switch 64 when the swicth is closed, and lead 126 provides a 12 VDC signal from switch 64 when the switch is open. Portion 60 of the linear displacement device 58 will move upwardly from a retracted position as the workpieces 24 are being clamped between clamping members 26 and 28; and this upward movement will cease with portion 60 in a set position when the workpieces, having a composite thickness t, are clamped together as shown in FIG. 4. As the portion 60 moves in the sensing direction from its retracted position towards its set or thickness sensing position it passes through a trip position which corresponds to the position at which switch 64 is closed by the movement of arm 66 in response to follower 70 moving outwardly along surface 68.

The set position of the sensing apparatus will vary depending on the composite thickness t of the workpieces being sensed, but the trip position will always be at the same position for each sensing operation. Of course the trip position could be made manually adjustable if necessary to accommodate large variations in composite thicknesses t by making the position of arm 64 or the position of surface 68 adjustable. In any event, switch 64 provides a 12 VDC signal from power supply 62 at lead 122 when and only when movable portion 60 is between the trip and set positions and provides a 12 VDC signal at lead 126 when and only when portion 60 is between the retracted and trip positions.

Leads 122, 124, and 126 are connected to a latch circuit 128 including NAND gates 130 and 132, and the function of the latch is to stabilize the transition between open and closed positions of switch 64. Thus, for example, with a 12 VDC signal at lead 122 and a OVDC signal at lead 126 the signal at output 134 of the latch 128 will be positive, and with a 12 VDC signal at lead 126 and a OVDC signal at lead 122 the signal at output 134 will be negative.

The output 134 is connected to a pulsing circuit 136 which includes a timing circuit 138 and a pulse-generating circuit 140. The timing circuit 138 provides a pulse after a 200 millisecond delay in response to a positive signal from output 134. The pulse-generating circuit 140 will, in response to the pulse from timing circuit 138, immediately generate a pulse at its output 142. The output 142 is connected to the priority encoders of logic circuit 90 through an OR gate 144 and a level converting amplifier 146, and the pulse at output 142 is a one microsecond strobe signal which sets the latch circuit according to the digital signal from outputs 88*a* at that instant. The level converting amplifier 146 may be identical to amplifiers 88 and serves the same purpose.

The output 142 is also connected to an enabling circuit 148 which responds to the one microsecond strobe signal by generating a signal of 300 milliseconds duration at its output 150. Output 150 is connected, as shown in FIG. 5A, to the series connected combination of an AND gate 152, another level converting amplifier 154, and a driver 156. Output 150 is connected to input 152*a* of AND gate 152, and output 158 of driver 156 is in turn connected to an input of each of the NAND gates 114.

A manually-operable switch 160 is connected to a second latch circuit 162 which operates in a manner similar to the latch circuit 128. In a first position, as shown in FIG. 5A, input 164*a* of NAND gate 164 sees a OVDC signal, and input 166*a* of NAND gate 166 sees a 12VDC signal. When the switch 160 is operated to its second position input 164*a* sees a 12VDC signal and input 166*a* sees a OVDC signal. The output 166*c* of NAND gate 164 will therefore be negative when switch 160 is in its first position (as shown) and will become positive when the switch is operated to its second position. The output 166*c* is connected to an input of enabling circuit 148, and a positive signal at output 166*c* will have the same effect on circuit 148 as a pulse at output 142.

An oscillator circuit 168 comprising a free running oscillator 170 has an output 170*a* connected to one input 172*a* of an AND gate 172. The output 172*c* of AND gate 172 is connected to input 144b of OR gate 144, and input 172b of AND gate 172 is connected to a calibrate mode switch 174. The calibrate switch is also connected to input 152b of the AND gate 152. With the calibrate switch 174 in the "operate" position (as shown) a negative signal will be present at input 172b and a positive signal will be present at input 152b. When the calibrate switch is operated to its "calibrate" position input 172b will see a positive signal and input 152b will see a negative signal. Thus the calibrate switch serves, when in the operating position, to couple the enable circuit 148 to NAND gates 114, and, in its calibrate position, to couple the oscillator circuit to the priority encoders. While the calibrate switch is in its calibrate position the oscillator circuit will continuously reset the priority latches so that the signals at outputs 101–112 will continuously reflect any changes in the analog signal from the sensing means.

In the embodiment of the invention disclosed herein the components of the selection and triggering circuit on the input side of the level converting amplifiers 88, 146 and 154 are all of the CMOS type and are powered by 12 volt direct current (12VDC) from the power supply 62. The circuit components on the output side of the level converting amplifiers are of the TTL type and are powered by 5 volt direct current also supplied by power supply 62. The level converting amplifiers may be CD4050 integrated circuits. The power supply of the disclosed embodiment also provides 30 volt direct current to power the transducer and 12 volt direct current to switch 64. The power supply may be of any suitable type capable of providing the required current and voltage levels. As shown in FIGS. 5A and 5B a plurality of 10 microfarad capacitors 176 are provided to help eliminate line spikes.

The timing circuit 138, the pulse generating circuit 140, and the enabling circuit 148 may each include an SN74C221 integrated circuit; and the oscillator circuit 168 may utilize a SN72555 integrated circuit. The NAND gates 130, 132, 164, and 166 may each comprise an SN74C00 integrated circuit; and the NAND gates 144 may be SN7438 integrated circuits.

The gain adjustment circuit 80 may utilize a LM324 circuit chip or may be of any other suitable type. According to the circuit disclosed herein the level of the analog signal delivered to the gain adjustment circuit 80 is directly proportional to the composite thickness t sensed by the transducer, and the circuit 80 acts as an inverter so that the analog signal provided to analog-to-digital converter circuit 84 is inversely proportional to the sensed thickness t.

The electro-pneumatic relay 56 is well within the present state of the art and will not be described in detail. It merely directs compressed air received at an input 56a to a selected output in response to the actuation of a corresponding one of solid state relays 118 by a dispensing signal. The relays 118 switch 110 volt AC power to operate pneumatic valves in response to low voltage dispensing signals from a triggering circuit comprising gating circuit 113, enabling circuit 148, and the AND gate 152.

The procedure for calibrating the selection circuit will now be described. Each level sensing amplifier 86 is connected to an associated potentiometer 176, and the adjustment of each potentiometer 176 determines the level of the reference signal seen by that particular amplifier. Therefore, in order to calibrate the selection circuit each potentiometer 176 is first adjusted so that the reference signals are all set at their maximum voltage levels. With all reference signal levels thus set at maximum, all twelve outputs of the converter circuit 84 will show 0 volts.

The calibrate switch 174 is then operated from the operate to the calibrate position. With the switch 174 in the calibrate position the signal at input 152a of AND gate 152 is held negative, and therefore one input for each of the NAND gates 114 of gating circuit 113 sees a negative signal also. Thus while the calibrate switch is in the calibrate position no dispensing signals can be generated by the triggering circuit. In addition, while the calibrate switch is in the calibrate mode input 172b of AND gate 172 will see a positive signal, and pulses from oscillator 170 will be coupled by AND gate 172 through OR gate 144 and level converting amplifier 146 to the logic circuit 90. These pulses from the oscillator continuously reset the latches of the priority encoders 92 and thus cause the logic circuit to continuously sample the digital output of converter circuit 84 and update the output signal being generated by the logic circuit at any given time. Of course the particular output of logic circuit 90 generating an output signal at any given time is indicated visually by an associated LED 120 of display circuit 116.

A first template is then selected which has a thickness equal to the maximum allowable composite thickness of workpieces to be riveted using the longest selectable rivet. With the drilling mechanism of the riveting machine disabled this template is clamped between the upper and lower clamping members, and the potentiometer associated with the amplifier 86 connected to the lowest priority latch is then adjusted until its associated LED just comes on. The first template is then removed and a second template representing the minimum allowable composite thickness for which the longest selected rivet can be used is clamped into place. The potentiometer associated with the amplifier 86 connected to the next higher priority latch is then adjusted until the first LED goes out and the next LED just comes on. This defines the range of composite thicknesses for which the longest selectable rivet will be selected. The same procedure is then repeated using templates representing the maximum and minimum composite thicknesses respectively for which the next shorter selectable rivet is appropriate, and the procedure is repeated again and again until the selection circuit has been calibrated for all of the different selectable rivet lengths. With the specific circuit shown, up to twelve different thickness ranges corresponding to twelve different rivet lengths may be selectable; and if fewer than twelve choices are desired, the unneeded priority latches are simply disabled by adjusting the reference signals for their associated level sensing amplifiers to maximum levels. Each of the unneeded priority latches will therefore remain unable to generate an output signal since the analog signal levels at the inputs 86a of those amplifiers associated with the unneeded latches will never exceed the reference signal levels at the inputs 86b of those amplifiers.

Once the selection circuit has thus been calibrated the drilling mechanism is enabled, and the calibrate switch is operated back to its operate position. This results in a negative signal at input 172b of AND gate 172 and a positive signal at input 152a of AND gate 152. The OR gate 144 is therefore rendered unresponsive to pulses generated by the oscillator circuit 168, and gating circuit 113 becomes once again responsive to signals from output 150 of the enabling circuit 148.

Once the selection circuit has been calibrated for a series of riveting operations utilizing, for example, eight different rivet lengths the operation of a riveting system including the present invention will be generally as follows.

The operator first positions the workpieces between clamping members 26 and 28 with the spot to be riveted directly below the drill as shown in FIG. 4. A switch, which may be located on the riveting machine, is operated to effect an upward movement of the lower clamping member 28; and the lower clamping member responds by moving upwardly until the workpieces are clamped in position for the riveting operation. The level of the analog signal generated by the sensing means increases as the lower clamping member moves upwardly toward the workpieces until, with the workpieces clamped in place, the signal reaches a level representing the composite thickness t.

If we assume, for purposes of illustration, that the signal level representing thickness t in this case is higher than the reference signal levels at inputs 86*a* of the first seven level sensing amplifiers 86 (counting up from the bottom in FIG. 5B) but not as high as the reference signal level inputs to the remaining five level sensing amplifiers, then the digital signal output from converter circuit 84 will comprise a positive signal at each output 86*c* of the first seven amplifiers 86 and no signals from the remaining five amplifiers 86. This digital signal is then received by logic circuit 90 so that the priority latches corresponding to outputs 101–107 each see a positive signal while the priority latches corresponding to outputs 108-112 see a zero level signal.

As the lower clamping member 26 approaches its clamped position, the movable portion 60 of the sensing means passes through its trip position, thereby causing latch circuit 128 to generate a positive signal received by the pulsing circuit 136. Within the pulsing circuit, timing circuit 138 provides a 200 millisecond delay, and pulse generating circuit 140 then generates a strobe pulse which is received by both the enabling circuit 148 and the OR gate 144.

The strobe pulse to OR gate 144 is coupled to the priority latches of logic circuit 90 and causes one of the priority latches, in this case the priority latch associated with output 107, to set. The priority latch associated with output 107 is the one to set in this case because at the time the pulse from the pulsing circuit is received by the priority latches it is the highest priority latch seeing a positive signal from converter circuit 84. Thus, upon the setting of the priority latch circuit of logic circuit 90 in response to the signal from pulsing circuit 136 an output signal is generated at output 107 while the remaining outputs (101–106 and 108–112) generate no output signal. The output signal at output 107 is received by both the LED 120 and the NAND gate 114 which are associated with output 107, so that the LED is illuminated and a positive signal is seen at input 114*a* of the NAND gate while the priority latch remains set.

The strobe pulse to the enabling circuit 148 causes the enabling circuit to generate a signal at output 150 having a duration of 300 milliseconds. This signal is coupled through AND gate 152 to the inputs 114*b* of the NAND gates 114, so the the NAND gate 114 associated with logic circuit output 107 will trigger a dispensing signal generated at output 114*c*. This dispensing signal at output 114*c* will in turn actuate, for 300 milliseconds, the relay 118 connected to the NAND gate 114 providing the dispensing signal. Of course only a single dispensing signal will be provided since only one NAND gate 114 sees a positive signal at its input 114*a*.

Actuation of the one relay 118 causes its corresponding pneumatic valve to open briefly to operate its corresponding gate member 46 of dispensing mechanism 16. This causes a single rivet of the proper length to be delivered through conduit 18 to the riveting machine. A drilling operation is performed on the workpieces as soon as the workpieces are clamped in place. Thus the drilling operation occurs while the rivet selection and delivery operations are taking place. If for some reason a rivet is not properly delivered as a result of the normal operations just described, the operator simply operates switch 160 to its second position. This causes gate 162 to present a positive signal at output 166*c* and in turn cause enabling circuit 148 to generate another 300 millisecond signal. Since the logic circuit has not been reset in the interim this signal will effect a second dispensing signal identical to the first.

Once the heading oepration on the rivet is complete the operator causes the lower clamping member to move downwardly and release the workpieces. As the lower clamping member moves downwardly the movable portion 60 of the sensing means moves towards its retracted position, and as it passes the trip position the switch 64 causes latch circuit 128 to eliminate the positive signal at output 134. The operator can then begin another riveting operation by positioning other workpieces or other parts of the same workpieces and clamping them in place.

The invention as disclosed herein provides a number of very significant advantages including precision, reliability, and speed in the selection of individual fasteners according to size. The manual triggering feature allows the dispensing of additional fasteners of the size previously determine by the sensing means to be optimum without the necessity of re-clamping the workpieces or performing another drilling operation. This feature, in effect, provides the selection apparatus with a memory so that a second fastener of appropriate size may be dispensed in cases where for some reason the first fastener to be dispensed was not properly delivered or installed.

The invention also provides a very versatile fastener selection system in that the selection circuit could be constructed with virtually any number of priority latches so that any desired number of different fastener sizes could be accommodated. Of course, any unneeded priority latches are easily disabled. In addition, as previously indicated the analog-to-digital converter circuit is easily calibrated so that each priority latch may represent as broad or as narrow a range of thicknesses as is desired, and the calibration switch will disable the triggering circuit while enabling the coupling of clock pulses to the priority latch circuit during a calibration mode.

By coupling both the selection circuit and the triggering circuit to the sensing means the disclosed system according to the invention facilitates an efficient automatic selection and triggering of a fastener dispensing operation in response to the clamping of workpieces for a fastening operation. The gain adjustment circuit and the adjustability of the time delay provided by the timing circuit both make the selection apparatus adaptable to a variety of different types of fastener dispensing and installation equipment, and the visual display circuit assists the operator both during normal operation of the selection circuit and while the apparatus is in a calibrate mode.

While only the presently preferred embodiment of the invention has been disclosed herein, it will be obvious to one skilled in the art that one or more of the features included in this preferred embodiment could be deleted without sacrificing the advantages afforded by the basic invention. For example, in the sensing means the switch 64 associated with the linear displacement device could be eliminated and a manually-operable switch substituted therefore, or the manual triggering switch 160 and its associated circuitry could be eliminated. However, the preferred embodiment of the invention as described and without substantial modification will be well suited for many applications.

Thus the foregoing description of my invention discloses a preferred embodiment thereof, and various changes in form or detail may be made within the scope of the invention which is defined and limited only by the following claims.

What is claimed is:

1. In a fastener selection and dispensing apparatus including means for dispensing a fastener of appropriate size for fastening workpieces together in response to a dispensing signal representing said appropriate size, the improvement comprising:

sensing means for sensing a composite thickness of said workpieces and generating an analog signal proportional to said composite thickness;

a selection circuit including an analog-to-digital converter circuit connected to said sensing means and a logic circuit connected to said converter circuit, said logic circuit including at least a first and a second output corresponding to a first fastener size and a second fastener size respectively, said converter circuit responsive to said analog signal for generating a digital signal which is a function of said analog signal, said logic circuit responsive to said digital signal for generating an output signal at only one of said first and second outputs determined as a function of said digital signal; and a triggering circuit connected to said first and second outputs and responsive to said output signal for generating said dispensing signal.

2. In a fastener selection and dispensing apparatus as claimed in claim 1 wherein said triggering circuit comprises at least a first and a second gate, said first gate connected to said first output and activated in response to an output signal from said first output for generating a first dispensing signal representing a first fastener size, said second gate connected to said second output and activated in response to an output signal from said second output for generating a second dispensing signal representing a second fastener size.

3. In a fastener selection and dispensing apparatus as claimed in claim 1 wherein said logic circuit comprises a priority latch circuit, and said selection circuit includes a pulse-generating circuit connected to said priority latch circuit for selectively generating a pulse to reset said priority latch circuit, said output signal at said one of said outputs generated upon the occurrence of said reset and maintained until a subsequent reset occurs.

4. In a fastener selection and dispensing apparatus as claimed in claim 3 wherein said sensing means includes a linear displacement voltage device and wherein said linear displacement voltage device is movable between a set position and a retracted position and passes through a trip position when moving from said retracted position towards said set position, said sensing means including switch means connected to said pulse-generating circuit and responsive to the position of said linear displacement device for providing a signal whenever said linear displacement device reaches said trip position while moving from said retracted position towards said set position, said pulse-generating circuit responsive to said signal for generating said pulse.

5. In a fastener selection and dispensing apparatus as claimed in claim 3 wherein said sensing means includes a linear displacement device and wherein said linear displacement device is movable between a set position and a retracted position and passes through a trip position when moving from said retracted position towards said set position, said sensing means including switch means connected to said pulse-generating circuit and responsive to the position of said linear displacement device for providing a first signal whenever said linear displacement device is between said trip position and said set position and for providing a second signal whenever said linear displacement device is between said trip position and said retracted position, said selection circuit including a resettable latch circuit reset only by the presence of said second signal and connected between said switch means and said pulse-generating circuit, said pulse-generating circuit responsive to said first signal for generating said pulse, and said resettable latch circuit allowing the generation of only one said pulse following each reset of said resettable latch circuit.

6. In a fastener selection and dispensing apparatus as claimed in claim 4 wherein said pulse-generating circuit includes timing circuit means for providing a delay of preset duration between the time when said signal from said switch means is provided and the time when said pulse is generated in response thereto.

7. In a fastener selection and dispensing apparatus as claimed in claim 5 wherein said pulse-generating circuit includes timing circuit means for providing a delay of preset duration between the time when said first signal from said switch means is provided and the time when said pulse is generated in response thereto.

8. In a fastener selection and dispensing apparatus as claimed in claim 1 wherein said triggering circuit includes an enabling circuit connected to said gate circuit for selectively enabling said gate circuit.

9. In a fastener selection and dispensing apparatus as claimed in claim 3 wherein said triggering circuit includes an enabling circuit connected between said pulse-generating circuit and said gate circuit for enabling said gate circuit for a predetermined period in response to the generation of said pulse by said pulse-generating circuit.

10. In a fastener selection and dispensing apparatus as claimed in claim 9 wherein said selection circuit includes a manually-operable switch connected to said enabling circuit, said enabling circuit responsive to both said generation of said pulse and the operation of said switch for enabling said gate circuit.

11. In a fastener selection and dispensing apparatus as claimed in claim 1 wherein said triggering circuit includes an enabling circuit for selectively generating an enable signal, and wherein said gate circuit includes a plurality of NAND gates connected to said logic circuit and to said enabling circuit for triggering said dispensing signal only in response to the simultaneous presence of both an enable signal and an output signal.

12. In a fastener selection and dispensing apparatus as claimed in claim 3 wherein said triggering circuit includes an enabling circuit connected to said pulse-generating circuit and said selection circuit includes a manually-operable switch connected to said enabling circuit, said enabling circuit responsive to both the generation of said pulse by said pulse-generating circuit and the operation of said switch for generating an enable signal of predetermined duration, said triggering circuit including a gate circuit connected to said priority latch circuit and to said enabling circuit for actuating said triggering circuit only in response to the simultaneous presence of said enable and output signals from said enabling circuit and said priority latch circuit respectively.

13. In a fastener selection and dispensing apparatus as claimed in claim 1 wherein said apparatus includes calibration means for calibrating said selection circuit such that said first and second outputs each correspond to a different selected range of composite thicknesses.

14. In a fastener selection and dispensing apparatus as claimed in claim 1 wherein said converter circuit includes calibration means for selectively adjusting the functional relationship between said analog and said digital signals.

15. In a fastener selection and dispensing apparatus as claimed in claim 1 wherein said selection circuit includes means for selectively disabling at least one of said first and second outputs.

16. In a fastener selection and dispensing apparatus as claimed in claim 1 wherein said apparatus includes display means for visually indicating the appropriate size of fastener for fastening said workpieces together.

17. In a fastener selection and dispensing apparatus as claimed in claim 1 wherein said selection circuit includes a visual display circuit connected to said logic circuit and said visual display circuit is responsive to said output signal for indicating the one of said first and second outputs at which said output signal is generated.

18. In a fastener selection and dispensing apparatus as claimed in claim 13 wherein said apparatus includes a manually operable calibration switch connected to said selectin circuit for selectively operating said apparatus to a calibrate mode, said logic circuit continuously responsive to changes in said digital signal while said apparatus is operating in said calibrate mode, said apparatus further incuding means for providing a continuous visual indication of the one of said first and second outputs at which said output signal is generated.

19. In a fastener selection and dispensing apparatus as claimed in claim 18 wherein said calibration switch is connected to said triggering circuit and said triggering circuit includes means for disabling said triggering circuit whenever said apparatus is operating in said calibrate mode.

20. In a fastener selection and dispensing apparatus as claimed in claim 1 wherein said apparatus includes gain adjustment means for selectively adjusting the magnitude of said analog signal received by said converter circuit.

21. Fastener selection apparatus comprising:

sensing means for sensing the composite thickness of workpieces to be fastened together and generating an analog signal proportional to said composite thickness;

a selection circuit connected to said sensing means and having a plurality of outputs each corresponding to a different size of fastener, said selection circuit including an analog-to-digital converter circuit connected to said sensing means and a logic circuit connected between said converter circuit and said plurality of outputs, said converter circuit responsive to said analog signal for generating a digital signal which is a function of said analog signal, said logic circuit responsive to said digital signal for generating an output signal at only one of said outputs determined as a function of said digital signal; and a triggering circuit connected to the selection circuit outputs and responsive to said output signal for triggering a dispensing signal representing a size of fastener corresponding to said one output.

22. The fastener selection apparatus as claimed in claim 21 wherein said sensing means comprises a linear displacement voltage device, and said analog signal is a voltage signal generated by said linear displacement voltage device.

23. The fastener selection apparatus as claimed in claim 21 wherein said logic circuit comprises a priority latch circuit, and said selection circuit includes a pulse-generating circuit connected to said priority latch circuit for selectively generating a pulse to reset said priority latch circuit, said output signal at said one of said outputs generated upon the occurrence of said reset and maintained until a subsequent reset occurs.

24. The fastener selection apparatus as claimed in claim 23 wherein said sensing means includes a linear displacement voltage device, and wherein said linear displacement voltage device is movable between a set position and a retracted position and passes through a trip position when moving from said retracted position towards said set position, said sensing means including switch means connected to said pulse-generating circuit and responsive to the position of said linear displacement voltage device for providing a signal whenever said linear displacement voltage device reaches said trip position while moving from said retracted position towards said set position, said pulse-generating circuit responsive to said signal from said switch means for generating said pulse.

25. The fastener selection apparatus as claimed in claim 23 wherein said sensing means includes a linear displacement voltage device, and wherein said linear displacement voltage device is movable between a set position and a retracted position and passes through a trip position when moving from said restracted position towards said set position, said sensing means including switch means connected to said pulse-generating circuit and responsive to the position of said linear displacement voltage device for providing a first signal whenever said linear displacement voltage device is between said trip position and said set position and for providing a second signal whenever said linear displacement voltage device is between said trip position and said retracted position, said selection circuit including a resettable latch circuit reset only by the presence of said second signal and connected between said switch means and said pulse-generating circuit, said pulse-generating circuit responsive to said first signal for generating said pulse, and said resettable latch circuit allowing the generation of only one said pulse following each reset of said resettable latch circuit.

26. The fastener selection apparatus as claimed in claim 25 wherein said pulse-generating circuit includes timing circuit means for providing a delay of preset duration between the time when said first signal from said switch means is provided and the time when said pulse is generated response thereto.

27. The fastener selection apparatus as claimed in claim 21 wherein said selection circuit includes an enabling circuit connected to said triggering circuit for selectively enabling said triggering circuit.

28. The fastener selection apparatus as claimed in claim 23 wherein said triggering circuit includes an enabling circuit connected to said pulse-generating circuit, and wherein said selection circuit further includes a manually-operable switch connected to said enabling circuit, said enabling circuit responsive to both said generation of said pulse by said pulse-generating circuit and the operation of said switch for enabling said triggering circuit for a predetermined period.

29. The fastener selection apparatus as claimed in claim 23 wherein said selection circuit includes an enabling circuit connected to said pulse-generating circuit and a manually-operable switch connected to said enabling circuit, said enabling circuit responsive to both the generation of said pulse by said pulse-generating circuit and the operation of said switch for generating an enable signal of predetermined duration, said triggering circuit including gate means connected to said priority latch circuit and to said enabling circuit for actuating said triggering circuit only in response to the simultaneous presence of said enable and output signals from said enabling circuit and said priority latch circuit respectively.

30. The fastener selection apparatus as claimed in claim 21 wherein said selection circuit includes a visual display circuit connected to said logic circuit and responsive to said output signal for indicating the one of said plurality of outputs at which said output signal is generated.

31. The fastener selection apparatus as claimed in claim 21 wherein said apparatus includes calibration means for calibrating said selection circuit such that each output of said plurality of outputs corresponds to a different selected range of composite thicknesses.

32. The fastener selection apparatus as claimed in claim 21 wherein said converter circuit includes calibration means for selectively adjusting the functional relationship between said analog signals and said digital signals, said functional relationship being infinitely adjustable between preset limits.

33. The fastener selection apparatus as claimed in claim 31 wherein said apparatus includes a manually-operable calibration switch connected to said selection circuit for selectively operating said apparatus to a calibrate mode, and wherein said apparatus further includes means for providing a continuous visual indication of the one of said outputs at which said output signal is generated, said selection circuit including an oscillator circuit connected to said logic circuit and responsive to said calibration switch for rendering said logic circuit continuously responsive to changes in said digital signal while said apparatus is operating in said calibrate mode.

34. The fastener selection apparatus as claimed in claim 33 wherein said calibration switch is connected to said triggering circuit and said triggering circuit includes means for disabling said triggering circuit whenever said apparatus is operating in said calibrate mode.

35. Fastener selection apparatus comprising:

sensing means for sensing the composite thickness of workpieces to be fastened together and generating a first signal having a signal level proportional to said composite thickness, a selection circuit responsive to said first signal for providing an output signal designating only an appropriate one of a plurality of fastener sizes, switch means responsive to said sensing means for generating a second signal, and a triggering circuit responsive to both said output signal and said second signal for generating a dispensing signal only in the presence of both said signals, said dispensing signal representing a fastener of said appropriate size.

36. The fastener selection apparatus as claimed in claim 35 wherein said selection circuit is responsive to said second signal for updating said output signal.

37. The fastener selection apparatus as claimed in claim 35 including a timing circuit connected between said switch means and triggering circuit for providing a delay of preset duration between the generation of said second signal and the presence of said second signal at said triggering circuit.

38. The fastener selection apparatus as claimed in claim 35 including a manually operable switch connected to said triggering circuit said manually-operable switch generating a third signal when actuated by an operator, said triggering circuit responsive to said output signal, said second signal, and said third signal for generating a dispensing signal only in the presence of both said output signal and one of said second and third signals.

* * * * *